US010029878B2

(12) United States Patent
Sands

(10) Patent No.: US 10,029,878 B2
(45) Date of Patent: Jul. 24, 2018

(54) DUAL-STAGE SHEET STACKING AND DROPPING APPARATUS

(71) Applicant: Superior Paper Handling Solutions, Inc., Brooklyn Park, MN (US)

(72) Inventor: Steven G. Sands, Plymouth, MN (US)

(73) Assignee: Superior Paper Handling Solutions, Inc., Brooklyn Park, MN (US)

( * ) Notice: Subject to any disclaimer, the term of this patent is extended or adjusted under 35 U.S.C. 154(b) by 0 days.

(21) Appl. No.: 15/661,542

(22) Filed: Jul. 27, 2017

(65) Prior Publication Data

US 2017/0320695 A1 Nov. 9, 2017

Related U.S. Application Data

(62) Division of application No. 14/841,885, filed on Sep. 1, 2015, now Pat. No. 9,745,164.

(Continued)

(51) Int. Cl.
*B65H 31/30* (2006.01)
*B65H 31/20* (2006.01)

(Continued)

(52) U.S. Cl.
CPC ..... *B65H 29/26* (2013.01); *B65H 29/28* (2013.01); *B65H 29/34* (2013.01); *B65H 29/38* (2013.01);

(Continued)

(58) Field of Classification Search
CPC ..... B65H 31/30; B65H 31/3009; B65H 31/3018; B65H 29/34; B65H 29/26;

(Continued)

(56) References Cited

U.S. PATENT DOCUMENTS 5,431,530 A 7/1995 Kobayashi et al.
5,803,704 A 9/1998 Lazzarotti (Continued)

FOREIGN PATENT DOCUMENTS

EP 1195339 A2 4/2002

OTHER PUBLICATIONS

Prosecution History for U.S. Appl. No. 14/841,885 including: Issue Notification dated Aug. 9, 2017, Notice of Allowance dated Jun. 23, 2017, Amendment dated Apr. 25, 2017, Non-Final Office Action dated Mar. 3, 2017, Response to Restriction Requirement dated Nov. 15, 2016, Restriction Requirement dated Sep. 22, 2015, and Application and Drawings filed Sep. 1, 2015, 53 pages.

*Primary Examiner* — Luis A Gonzalez
(74) *Attorney, Agent, or Firm* — Christopher J. Volkmann; Kelly, Holt & Christenson, PLLC

(57) ABSTRACT

A method for rapidly stacking and dropping sheets is provided. The method comprises receiving a plurality of sheets from a sheet delivery device onto a landing platform of a stacking and dropping apparatus. The method also comprises lowering the landing platform from an original upper position. Lowering comprises maintaining a drop height between the sheet delivery device and a stack of delivered sheets. The method also comprises sending a delay signal that comprises a command to delay the receiving of the plurality of sheets from the sheet delivery device. The delay signal is sent in response to a detection of a predetermined stack height of the stack of delivered sheets. The method also comprises sending a movement signal, immediately following the sending of the delay signal. The movement signal comprises a command to move the landing platform, such that the plurality of sheets are received by a catch tray unit. The method also comprises dropping, utilizing the catch tray unit, the plurality of sheets onto a sheet receiving device. The method also comprises returning, automatically, (Continued)

the landing platform to the original upper position. The method also comprises sending a resume signal, that includes a command to the sheet delivery device to resume sheet delivery. The delay signal, movement signal and resume signal are sent by a central processor component of the stacking and dropping apparatus.

12 Claims, 6 Drawing Sheets

Related U.S. Application Data

(60) Provisional application No. 62/047,886, filed on Sep. 9, 2014.

(51) Int. Cl.

| | |
|---|---|
| ***B65H 29/34*** | (2006.01) |
| ***B65H 29/26*** | (2006.01) |
| ***B65H 31/34*** | (2006.01) |
| ***B65H 31/32*** | (2006.01) |
| ***B65H 31/00*** | (2006.01) |
| ***B65H 29/38*** | (2006.01) |
| ***B65H 29/28*** | (2006.01) |
| ***B65H 43/02*** | (2006.01) |

(52) U.S. Cl.
CPC ..... *B65H 31/00* (2013.01); *B65H 31/20* (2013.01); *B65H 31/3009* (2013.01); *B65H 31/3018* (2013.01); *B65H 31/32* (2013.01); *B65H 31/34* (2013.01); *B65H 43/02* (2013.01)

(58) Field of Classification Search
CPC ..... B65H 31/18; B65H 31/32; B65H 31/20; B65H 43/06; B65H 43/08; B65H 43/04; B65G 57/06
See application file for complete search history.

(56) References Cited

U.S. PATENT DOCUMENTS

| | | | | |
|---|---|---|---|---|
| 6,231,039 | B1 | 5/2001 | Chung | |
| 6,394,443 | B1 | 5/2002 | Vedoy | |
| 6,491,492 | B1 | 12/2002 | Cook | |
| 6,644,644 | B2 | 11/2003 | Vedoy | |
| 7,661,671 | B2 | 2/2010 | Yamazaki et al. | |
| 8,356,967 | B2 * | 1/2013 | Gammerler | B65G 57/00 271/218 |
| 8,657,555 | B2 * | 2/2014 | Kokubo | B65H 31/20 271/215 |
| 9,745,164 | B1 | 8/2017 | Sands | |
| 2014/0193233 | A1 | 7/2014 | Matsumoto et al. | |

* cited by examiner

DUAL-STAGE SHEET STACKING AND DROPPING APPARATUS

CROSS REFERENCE TO RELATED APPLICATIONS

The present application is a Divisional Application of U.S. patent application Ser. No. 14/841,885, filed Sep. 1, 2015, which is based on and claims the benefit of U.S. Provisional Patent Application Ser. No. 62/047,886, filed Sep. 9, 2014, entitled Dual-Stage Sheet Stacking and Dropping Apparatus, the contents of which is hereby incorporated in its entirety.

BACKGROUND

A stacking apparatus is often placed adjacent to, or attached to, a discharge end of a sheet-feeding device, conveyor system, or other sheet-delivery mechanism. The stacking apparatus generally functions to allow discharged, for example, envelopes, labels, stock, cards, sheets, and the like to stack neatly until an operator or an automated system removes the discharged sheets from the stacking apparatus. Preferably, the stacking apparatus can be adjusted in two dimensions to accommodate items of varying dimensions.

A dropper-style stacking apparatus generally includes a mechanism for dropping a predetermined number of stacked sheets into an appropriate receiving device below, such as a catch bin, conveyor system or secondary sheet-feeding apparatus. When a dropper-style stacking apparatus is designed to accommodate a relatively large stack of sheets, the sheet-feeding device must generally feed sheets slowly into such a large-capacity stacking apparatus. The slower sheet-feeding speed is required because the sheets initially being fed into a larger stacking apparatus must fall a greater distance. Sheets dropping a greater distance at high speeds often tend to become disorganized on their descent into the larger stacking device, creating undesirable jams.

SUMMARY

A method for rapidly stacking and dropping sheets is provided. The method comprises receiving a plurality of sheets from a sheet delivery device onto a landing platform of a stacking and dropping apparatus. The method also comprises lowering the landing platform from an original upper position. Lowering comprises maintaining a drop height between the sheet delivery device and a stack of delivered sheets. The method also comprises sending a delay signal that comprises a command to delay the receiving of the plurality of sheets from the sheet delivery device. The delay signal is sent in response to a detection of a predetermined stack height of the stack of delivered sheets. The method also comprises sending a movement signal, immediately following the sending of the delay signal. The movement signal comprises a command to move the landing platform, such that the plurality of sheets are received by a catch tray unit. The method also comprises dropping, utilizing the catch tray unit, the plurality of sheets onto a sheet receiving device. The method also comprises returning, automatically, the landing platform to the original upper position. The method also comprises sending a resume signal, that includes a command to the sheet delivery device to resume sheet delivery. The delay signal, movement signal and resume signal are sent by a central processor component of the stacking and dropping apparatus.

These and other various features and advantages that characterize the claimed embodiments will become apparent upon reading the following detailed description and upon reviewing the associated drawings.

DETAILED DESCRIPTION

Figure 1B:
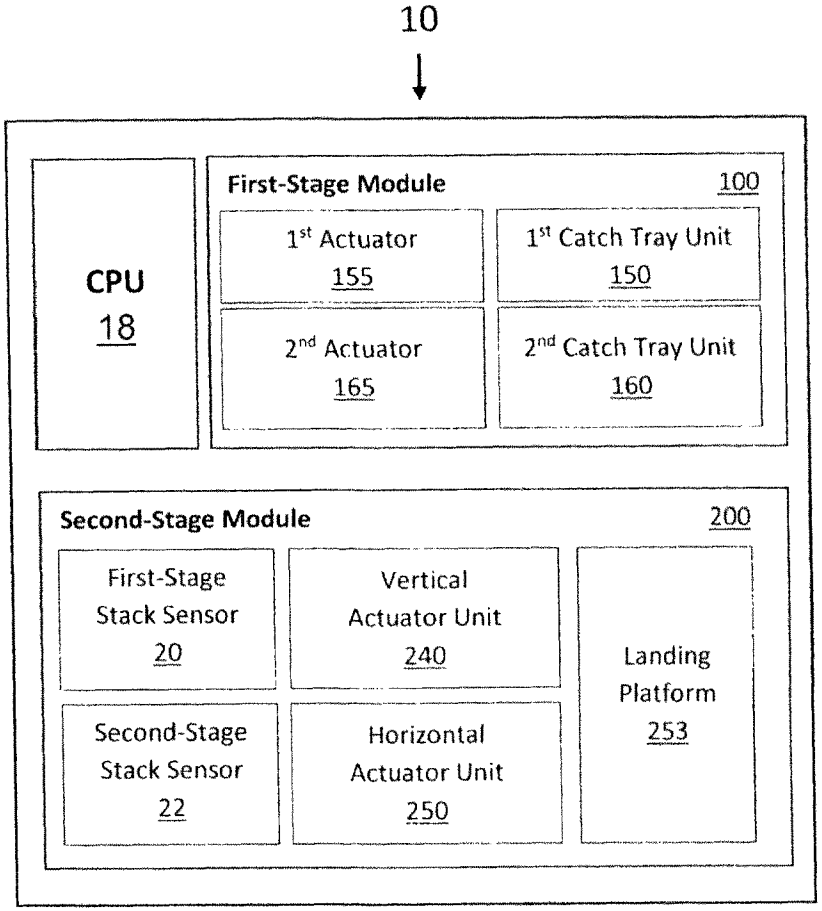
FIG. 1*b* is a block diagram of an exemplary dual-stage sheet stacking system in accordance with an embodiment of the present invention.

To provide an understanding of some of the basic principles of some embodiments of the present invention, reference is made to the embodiments shown in the drawings, and specific terms will be employed to describe the same. It should be understood, however, that no limitation of the scope of the invention is thereby intended. Instead, the invention includes any and all such alterations and improvements of the illustrated device that would normally occur to one skilled in the art to which the invention relates.

These and other features of some embodiments of the present invention will be more readily and fully understood by reference to the accompanying drawings and the detailed description that follows.

Many existing accumulators/droppers are configured to accumulate and drop material in stacks under 2 inches in height. Most droppers focus on a smaller count of material that creates a stack under 1 inch in height. The dropper platforms are typically within 1 to 1.5 inches below the discharge point of the feeder/dispenser to which they are attached. With this relatively shallow position, the material or sheet can leave the feeder at an angle under 20 degrees relative to horizontal, which may fall within an angle range for maximizing the speed at which the material can be fed into the dropper. The steeper the downward angle the material is when leaving the feeder, the more the material needs to bend or deflect back to horizontal in order to stack properly. This makes it more difficult to control the material after leaving the feeder, which leads to increased jams as speeds increase. Often, existing droppers slow the feeder to reduce jams. While jams may be reduced, a job time is increased, which is inefficient.

It is desired for an accumulator/dropper to be configured such that it can accumulate taller stacks, for example with heights in excess of 2 inches. However, as the dropper is lowered relative to the discharge point from the feeder in order to accumulate taller stacks, the material has to dispense at increasingly steeper angles, which increases the risk of jams.

Figure 1A:
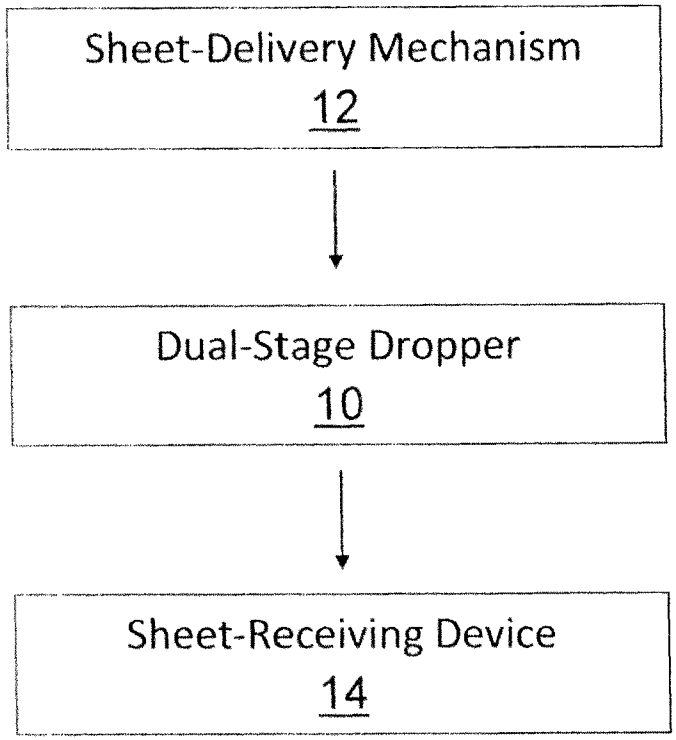
FIG. 1*a* illustrates an exemplary process flow diagram depicting a process flow in which embodiments described herein are useful.
Figure 2A:
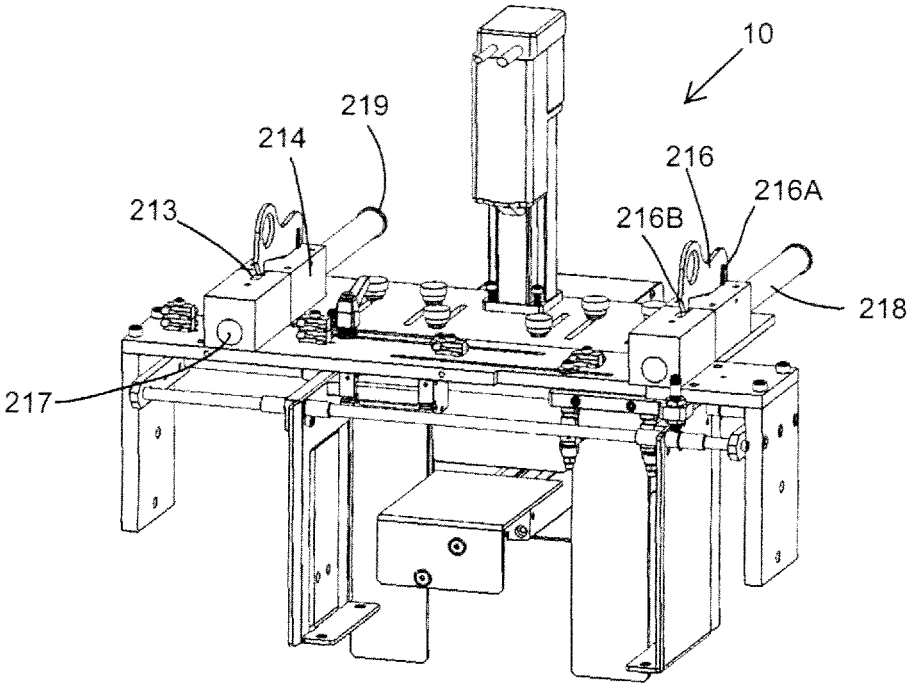
FIG. 2*a-c* are perspective views of a dual-stage dropper with which embodiments described herein may be useful.
Figure 2B:
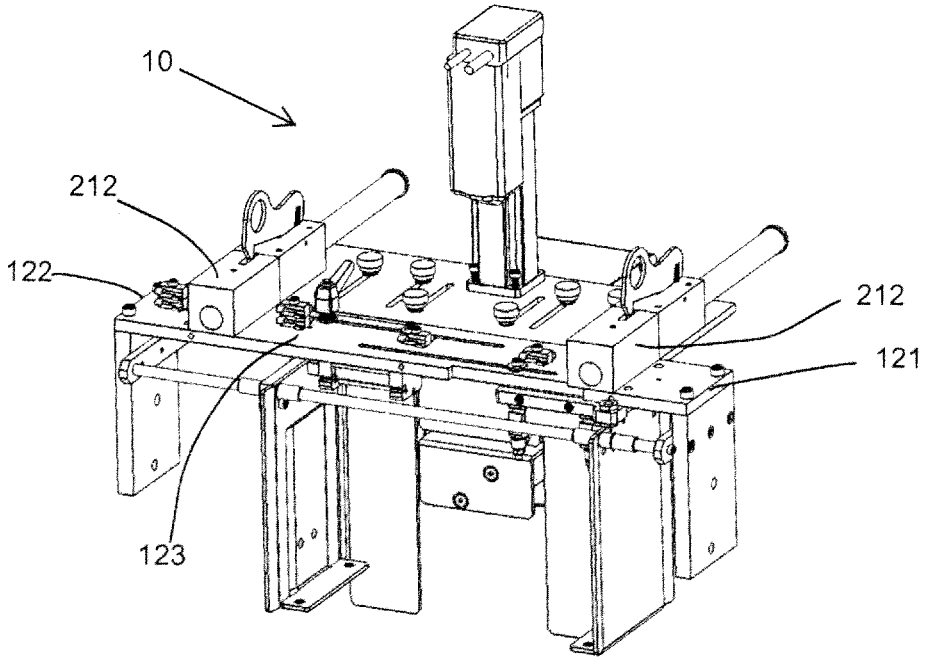
Figure 2C:
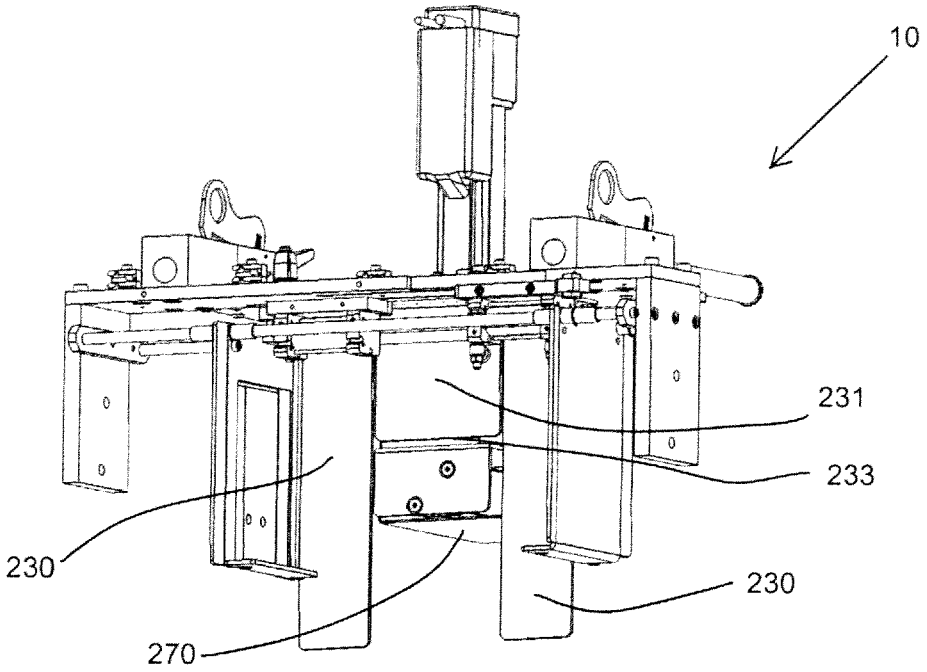

FIG. 1*a* illustrates an exemplary process flow diagram that may be useful in one embodiment of the present invention. The dual-stage dropper 10, in one embodiment, is configured for placement adjacent to a discharge end of a sheet-feeding device, conveyor system, or other appropriate sheet-delivery mechanism 12. The dual stage dropper 10, in one embodiment, is configured to receive and handle envelopes, cards, labels, sheets, and the like (hereinafter sheets) discharged by the sheet-delivery mechanism 12. The dual stage dropper, in one embodiment, is configured to drop the sheets uniformly onto a sheet receiving device 14.

FIG. 1*b* illustrates a block diagram of an exemplary dual-stage sheet stacking system in accordance with an embodiment of the present invention. The dual-stage dropper 10, in one embodiment, includes a central processing unit (CPU) 18, a first stage module 100 and a second stage module 200. In one embodiment, the first stage module 100 includes; a first actuator 155, a second actuator 165, a first catch tray unit 150 and a second catch tray unit 160. The second-stage module, in one embodiment, includes a first-stage-stack sensor 20, a second-stage-stack sensor 22, a vertical actuator unit 240, a horizontal actuator unit 250 and a landing platform 253.

Adding a second stage module 200 to the dropper 10 assists the material in dispensing at the optimum angle for maximized speed, while accommodating taller stacks and maintaining an efficient speed. The second stage module 200 provides a platform at a position relative to the feeder discharge such that the material angle is in a range allowing for efficient completion of a stacking job. The second stage platform 253 then descends as material is accumulated so the dispensed material is constantly fed on to the stack at a constant discharge angle. When the stack is complete, the second stage platform 253 is retracted to place the stack into the first stage module 100. The second stage platform 253 can then ascend to the upper most position ready for the next stack to start dispensing.

The second stage platform 253 can be controlled through sensors and/or software (described in further detail below) to adjust the uppermost position so it is in the optimum position for the specific type and size of material being dispensed. The second stage module 200 can also be controlled to retract prior to completion and return to the upper most position while the feeder is completing the dispensing of the stack into the first stage module 100. In applications requiring stack heights shorter than the first stage module 100 can hold, the second stage module 200 can retract and place the first stack in the first stage module 100, then move into the upper most position and the next stack can start and potentially finish prior to the first stage module 100 dropping the earlier stack onto the main system line. This can substantially increase the overall cycle rate of the system. With the second stage platform 200 integrated to the first stage module 100, the limiting factor to performance becomes a speed of the feeder/dispenser.

Figure 3A:
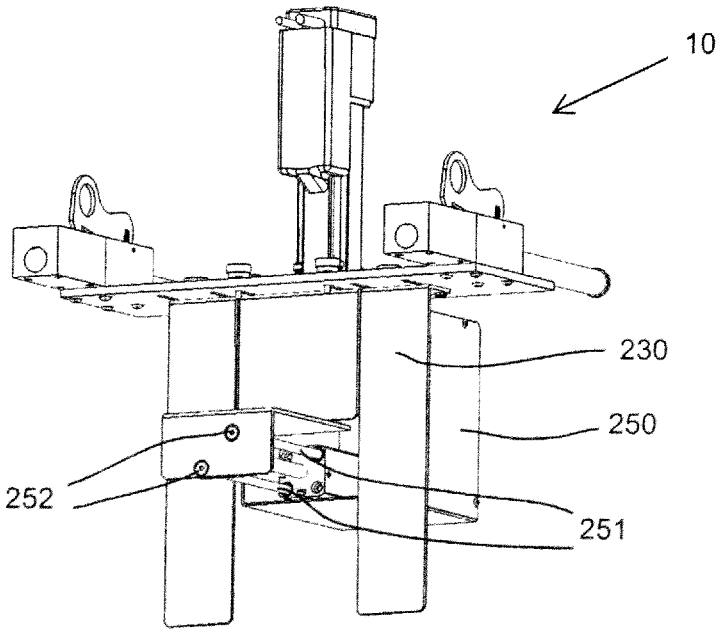
FIG. 3*a-c* illustrate isolated perspective views of several embodiments of the second-stage module of the dual-stage dropper.
Figure 3B:
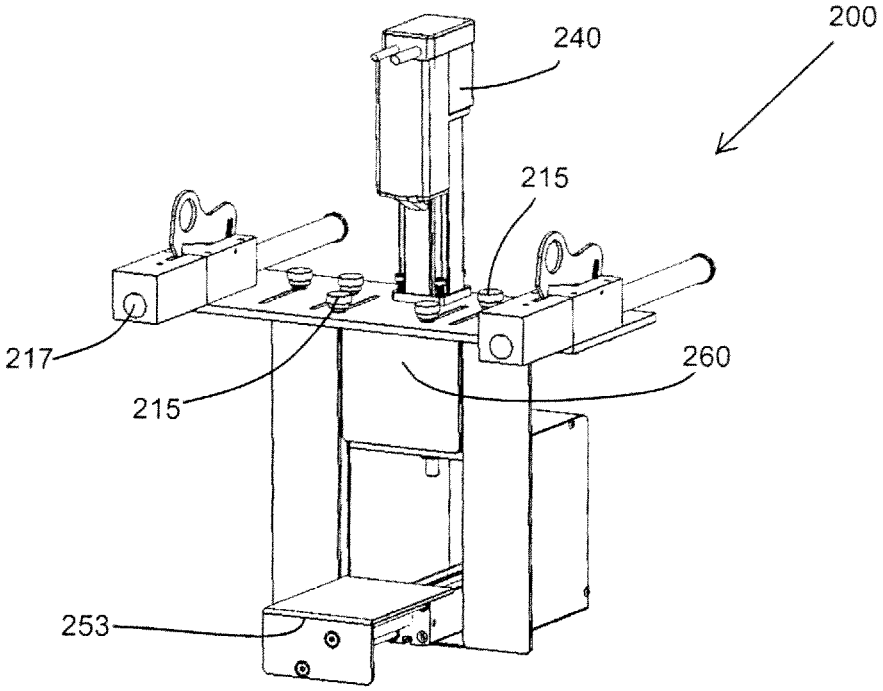
Figure 3C:
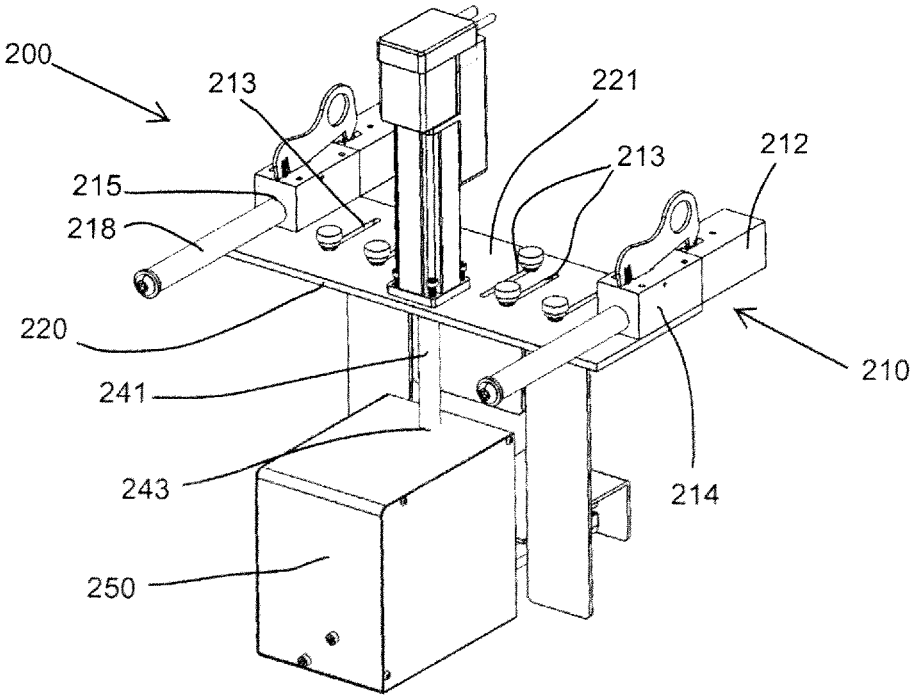

Referring to FIGS. 3*b* and 3*c*, the second-stage module 200 includes a pair of attachment units 210 designed to connect the second-stage module 200 to the first-stage module 100. Each of the pair of attachment units 210, in one embodiment, comprises a sliding block 214 affixed to one of two outer ends of a top side 221 of a second-stage upper platform 220. A central bore 215, passing through a length of the sliding block 214, is sized to slidably receive a disengagement rail 218, in one embodiment. A disengagement rail first end 217 extends through the central bore 215 toward the sheet-delivery mechanism 12 and is firmly attached to a fixed block 212, in one embodiment.

The dual-stage dropper 10, in one embodiment, can be adjusted by an operator to accommodate sheets of varying dimensions. Further, mechanical interaction between a second-stage module 200 and a first-stage module 100 of the dual-stage dropper 10 may allow, in one embodiment, the stacking of relatively large stacks of sheets being fed by a sheet-delivery mechanism 12 at relatively high speeds without creating frequent paper jams. In the unlikely event of a paper jam, the dual-stage dropper 10 is configured for easy separation of the second-stage module 200 from the first-stage module 100, so that an operator can efficiently clear a jammed sheet from the dual-stage dropper 10.

In one embodiment, one of the pair of fixed blocks 212 is affixed proximate to a first end 121 of on an upper side 123 of a first-stage upper platform 120. In one embodiment, the other one of the pair of fixed blocks 212 is affixed proximate to a second end 122 of the upper side 123 of the first-stage upper platform 120. Each one of the pair of sliding blocks 214 is held adjacent to one of the pair of fixed blocks 212 by a holding mechanism 216, such as a release clip. In one embodiment the release clip is a manually operated release clip. A hinged end 216A of the holding mechanism 216, in one embodiment, is hingedly attached to the sliding block 214. A nose end 216B of the release clip 216 is snapped into a securing recess 213 in the fixed block 212. This allows an operator to draw the second-stage module 200 away from the first-stage module 100 by lifting each of the pair of nose ends 216B out of each of the securing recesses 213. However, in another embodiment, a different holding mechanism 216 can be used that allows for separation of the first-stage module 100 and second-stage module 200. The operator may then be able to slide both of the pair of sliding blocks 214 along both of the pair of disengagement rails 218 toward a disengagement rail second end 219 opposite the disengagement rail first end 217.

A plurality of sheet-width-adjustment slots 213 pass through the second-stage upper platform 220, in one embodiment. One or more fastening mechanisms 215, such as set screws, pass through the plurality of sheet-width-adjustment slots 213, in one embodiment. In one embodiment, the fastening mechanism 215 is a set screw. The one or more fastening mechanisms 215, may be, a threaded attachment with one or more back plates 230 descending vertically from a bottom side 222 of the second-stage upper platform 220. This may, in one embodiment, allow an operator to loosen the one or more fastening mechanisms 215 to reposition the one or more back plates 230 to accommodate sheets of different width being delivered to the dual-stage dropper 10 from the sheet-delivery mechanism 12. In another embodiment, a lower edge 233 of a centrally positioned back plate 231 descends to a position just above an upper-most vertical position of a retractable landing platform 253 (described below). In one embodiment, at least one material control band (not shown) is mounted to the centrally positioned back plate 231 or the one or more back plates 230. The material control band is made of flexible material, for example spring steel, designed to absorb the force of the sheets being fed into the dual-stage dropper 10 by the sheet-delivery mechanism 12. However, in another embodiment, another flexible material is used to absorb the force.

In one embodiment, a vertical actuator unit 240 is affixed to the second-stage upper platform 220. Upon receiving an electronic signal, for example from the CPU 18 in one embodiment, at least one vertical piston 241 is configured to descend or ascend vertically from the vertical actuator unit 240 through the second-stage upper platform 220, with a distal end 243 of the at least one vertical piston 241 attached to a horizontal actuator unit 250. Upon receiving an electronic command, in one embodiment, at least one horizontal piston 251 may also be configured to extend or retract horizontally from the horizontal actuator unit 250. In one embodiment, a distal end of the at least one horizontal piston 252 is attached to a retractable landing platform 253.

In one embodiment, a second-stage-stack sensor 22 is mounted on the centrally positioned back plate 231 in a position indicated by position 260. In one embodiment, the second-stage-stack sensor 22 is a photoelectric sensor. In another embodiment, the second-stage-stack sensor 22 is a different sensor type from the first-stage-stack sensor 20. In another embodiment, the first-stage-stack sensor 20 and second-stage-stack sensor 22 are the same sensor type. The second-stage-stack sensor 22 may be configured, in one embodiment, to be directed downward toward the retractable landing platform 253.

In one embodiment, the second-stage-stack sensor 22 is configured to sense a distance to a top of a growing stack of sheets accumulating on the retractable landing platform 253. For example, when the top of the growing stack of sheets reaches a predetermined level, the second-stage-stack sensor 22 sends a signal to the CPU 18 to direct the vertical actuator unit 240 to lower the retractable landing platform 253, for example, utilizing at least one vertical piston 241. The retractable landing platform 253 continues to descend so that the top of the growing stack of sheets stays at a uniform distance, for example no more than 2 inches below a discharge level of the sheet-delivery mechanism 12.

Figure 3D:
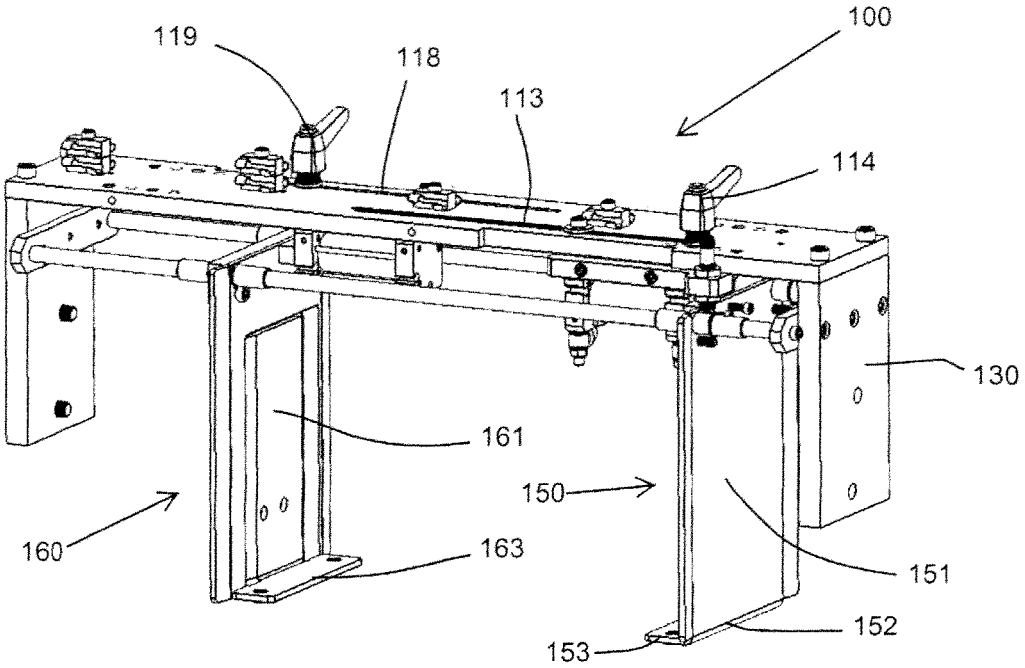
FIG. 3*d-e* illustrate isolated perspective views of one embodiment of the first-stage module of the dual-stage dropper.
Figure 3E:
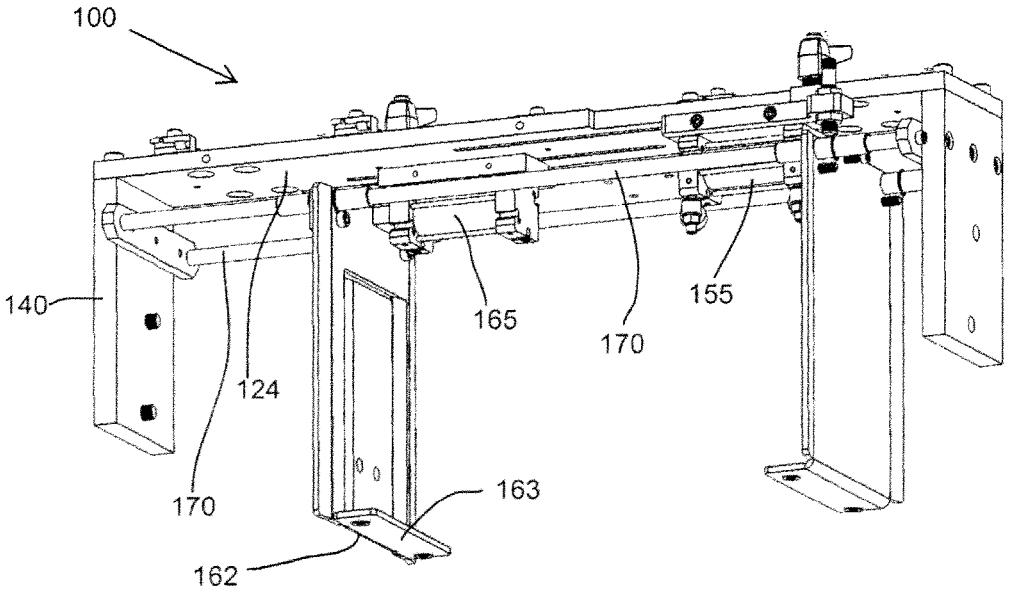

FIG. 3*d-e* illustrate isolated perspective views, of one embodiment of the first-stage module of the dual-stage dropper. In one embodiment, a first side member 130 is perpendicularly affixed to a lower side 124 of the first end 121 of the first-stage upper platform 120. In one embodiment, a second side member 140 is perpendicularly affixed to the lower side 124 of the second end 122 of the first-stage upper platform 120. A plurality of first-stage suspension rails 170 are mounted in parallel between the first side member 130 and the second side member 140.

In one embodiment, a first sliding catch tray unit 150 may be configured such that it is slidably mounted on the plurality of suspension rails 170 in proximity to the first side member 130. A first catch tray sheet-length-adjustment slot 113 passes through the first-stage upper platform 120. One or more first catch tray fastening mechanisms 114, such as set screws, pass through the first catch tray sheet-length-adjustment slot 113. The one or more first catch tray fastening mechanisms 114 are in threaded attachment with the first sliding catch tray unit 150. The operator may be able to, in one embodiment, loosen the one or more first catch tray fastening mechanisms 114 to reposition the first sliding catch tray unit 150 to accommodate sheets of different length being delivered to the dual-stage dropper 10 from the sheet-delivery mechanism 12. The first sliding catch tray unit 150 may comprise, in one embodiment, a first side panel 151 that projects perpendicularly away from the first-stage upper platform 120. A first stacking ledge 153, in one embodiment, is perpendicularly affixed to a first bottom edge 152 of the first side panel 151. The first stacking ledge 153, in one embodiment, projects away from the first side member 130 and toward the second side member 140.

A second sliding catch tray unit 160, in one embodiment, is slidably mounted on the plurality of suspension rails 170 such that is in proximity to the second side member 140. A second catch tray sheet-length-adjustment slot 118 passes through the first-stage upper platform 120. One or more second catch tray fastening members 119 pass through the second catch tray sheet-length-adjustment slot 118. In one embodiment, the fastening mechanisms 119 could be set screws. In another embodiment, the fastening mechanisms 119 could be another appropriate fastener.

In one embodiment, the one or more second catch tray fastening members 119 are in threaded attachment with the second sliding catch tray unit 160. The operator may be able to, in one embodiment, loosen the one or more second catch tray fastening members 119 to reposition the second sliding catch tray unit 160 to accommodate sheets of different length being delivered to the dual-stage dropper 10 from the sheet-delivery mechanism 12. The second sliding catch tray unit 160 may also comprise, in one embodiment, a second side panel 161 that projects perpendicularly away from the first-stage upper platform 120. A second stacking ledge 163, in one embodiment, is perpendicularly affixed to a second bottom edge 162 of the second side panel 161, the second stacking ledge 163 projects away from the second side member 140 and toward the first side member 130.

The first sliding catch tray unit 150, in one embodiment, further comprises a first catch tray actuator 155 in mechanical communication with the first side panel 151. Upon receipt of an electronic signal from the CPU 18, the first catch tray actuator 155, in one embodiment, is configured to cause the first side panel 151 (and the attached first stacking ledge 153) to slide along the plurality of suspension rails 170 toward the first side member 130. Upon receipt of another electronic signal from the CPU 18, in one embodiment, the first catch tray actuator 155 is configured to cause the first side panel 151 (and the attached first stacking ledge 153) to return to an original position on the plurality of suspension rails 170.

The second sliding catch tray unit 160, in one embodiment, further comprises a second catch tray actuator 165 that may be configured such that is in mechanical communication with the second side panel 161. Upon receipt of an electronic signal from the CPU 18, in one embodiment, the second catch tray actuator 165 may be configured to cause the second side panel 161 (and the attached second stacking ledge 163) to slide along the plurality of suspension rails 170 toward the second side member 140. In one embodiment, upon receipt of another electronic signal from the CPU 18, the second catch tray actuator 165 may be configured to cause the second side panel 161 (and the attached second stacking ledge 163) to return to an original position on the plurality of suspension rails 170. In one embodiment, the first catch tray actuator 155 and the second catch tray actuator 165 may be operated simultaneously.

During operation of the dual stage dropper 10, in one embodiment, the sheet-delivery mechanism 12 may initially deliver a plurality of sheets onto the retractable landing platform 253 of the second-stage module 200. As described above, the retractable landing platform 253 may be gradually lowered by the vertical actuator unit 240 so that the top of the growing stack of sheets stays at a distance of approximately 1.5 inches to 2 inches below the discharge level of the sheet-delivery mechanism 12. Maintenance of a relatively consistent and minimal drop distance allows sheets to be discharged at a rapid rate by the sheet-delivery mechanism 12.

In one embodiment, when a first predetermined number of sheets is delivered onto the retractable landing platform 253, a signal is sent, by the CPU 18, to the sheet-delivery mechanism 12 to interrupt delivery of sheets to the dual stage dropper 10. A signal may, in one embodiment, be sent from the CPU 18 to the horizontal actuator unit 250 causing the at least one horizontal piston 251 to retract the retractable landing platform 253. In one embodiment, the first predetermined number of sheets is then dropped onto the first stacking ledge 153 and second stacking ledge 163 of the first-stage module 100 positioned below. The first predetermined number of sheets is, in one embodiment, cradled between the first stacking ledge 153 and the second stacking ledge 163 until a signal is sent by the CPU 18 to the first catch tray actuator 155 and the second catch tray actuator 165 to cause the first stacking ledge 153 and the second stacking ledge 163 to separate and drop the first predetermined number of sheets onto a sheet receiving device 14 configured to receive the first-predetermined number of sheets. In one embodiment, the sheet receiving device 14 comprises a catch bin, conveyor or a secondary sheet-delivery system 14.

After the first predetermined number of sheets is dropped from the retractable landing platform 253, the CPU 18 may, in one embodiment, be configured to send a signal to the horizontal actuator unit 250 to return the retractable landing platform 253 to an extended position. The CPU 18 may be configured, in one embodiment, to also send a signal to the vertical actuator unit 240 to return the horizontal actuator unit 250 to an upper position. The CPU 18 may then be configured to send a signal to the sheet-delivery mechanism 12 to begin delivery of a second predetermined number of sheets to the dual stage dropper 10. As described above, in one embodiment, the retractable landing platform 253 may gradually lowered by the vertical actuator unit 240 so that the top of the growing stack of sheets stays at a distance of approximately 1.5 inches to 2 inches below the discharge level of the sheet-delivery mechanism 12.

A first-stage-stack sensor 20, in one embodiment, maybe mounted on the horizontal actuator unit 250 in a position indicated by 270. The first-stage-stack sensor 20 may be directed toward a gap between the first stacking ledge 153 and the second stacking ledge 163 of the first-stage module 100. The first-stage-stack sensor 20 is lowered along with the horizontal actuator unit 250 as sheets are fed onto the retractable landing platform 253. If the first-stage-stack sensor 20 is lowered to a point where it senses a presence of sheets cradled in the gap between the first stacking ledge 153 and the second stacking ledge 163 of the first-stage module 100, the first-stage-stack sensor 20 is, in one embodiment, configured to send a signal to the CPU 18, which may automatically direct the sheet-delivery mechanism 12 to interrupt the flow of sheets being delivered to the dual stage dropper 10 until the sheets are dropped from the from the first-stage module 100. In another embodiment, the sensor may be configured to remain stationary and detect a distance between the retractable landing platform 253 and a stack of sheets. After the sheets are cleared from the first-stage module 100, in one embodiment, the CPU 18 may be configured to automatically direct the sheet-delivery mechanism 12 to resume delivery of the second predetermined number of sheets to the dual stage dropper 10. Delivery of additional pre-set numbers of sheets can be cycled through the dual-stage dropper 10 as described above.

Figure 4:
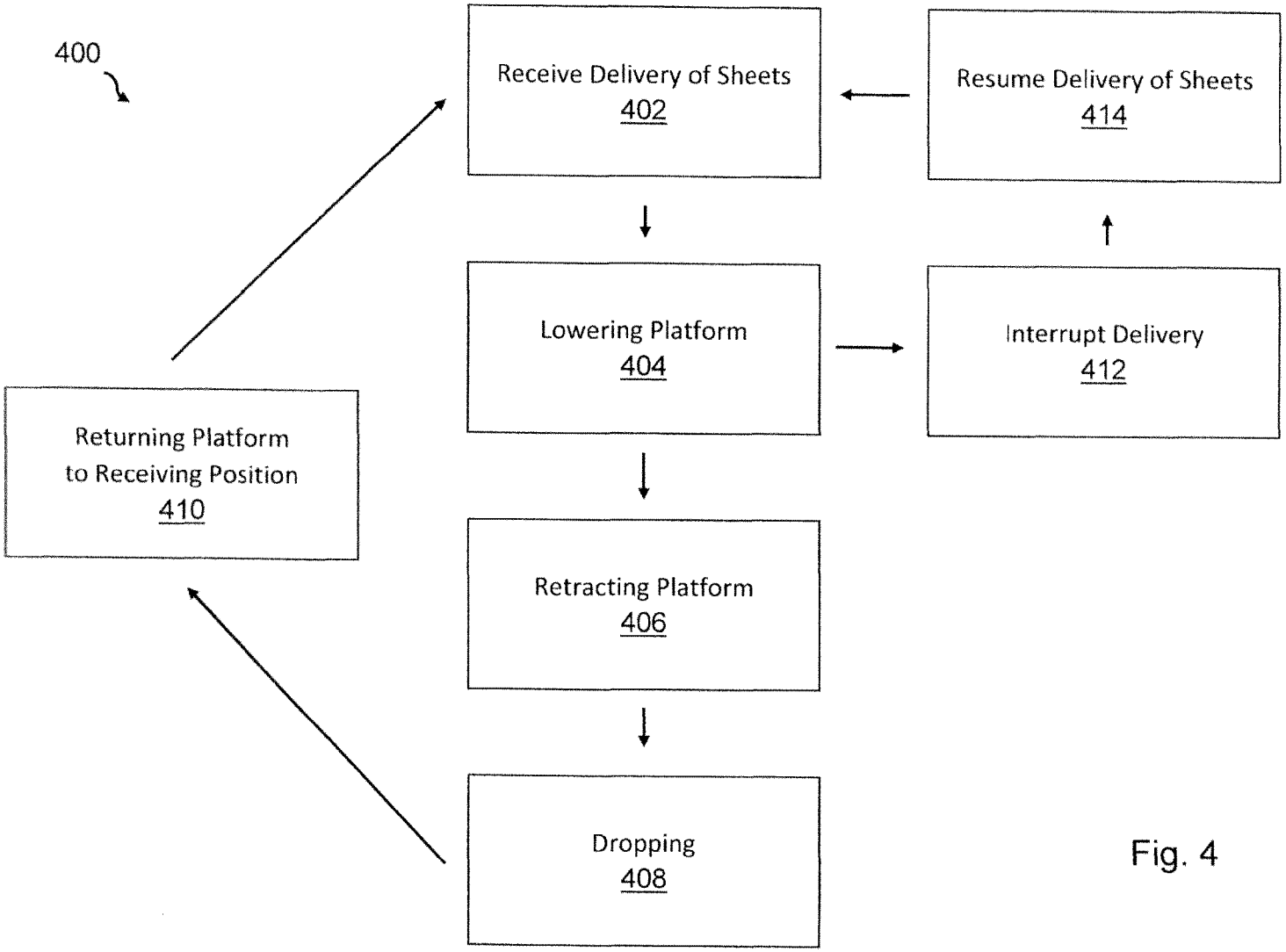
FIG. 4 illustrates an exemplary method of stacking and dropping in accordance with an embodiment of the present invention.

FIG. 4 illustrates an exemplary method of stacking and dropping in accordance with an embodiment of the present invention. In block 402, the sheet-delivery mechanism 12 initially delivers a plurality of sheets onto the retractable landing platform 253 of the second-stage module 200, in one embodiment. In block 404, the retractable landing platform 253 may, in one embodiment, be gradually lowered by a vertical actuator unit 240. In one embodiment, a top of a growing stack of sheets stays at a distance of approximately 1.5 to 2 inches below a discharge level of the sheet-delivery mechanism 12. Maintenance of a consistent and minimal drop distance may, in one embodiment, allow sheets to be discharged at a rapid rate by the sheet-delivery mechanism 12 without the creation of jams.

When a first, predetermined, number of sheets is delivered onto the retractable landing platform 253, in block 412, a signal is sent to the sheet-delivery mechanism 12 by the CPU 18 to interrupt delivery of sheets to the dual-stage dropper 10. Substantially, in one embodiment, in block 406, a signal is sent from the CPU 18 to the horizontal actuator unit 250 to retract the retractable landing platform 253. The first predetermined number of sheets may be dropped below, and cradled between, a first sliding catch tray unit 150 and a second sliding catch tray unit 160 of the first-stage module 100, in one embodiment. Upon receiving a command from the CPU 18, for example in block 408, one or more actuators may separate the first sliding catch tray unit 150 from the second sliding catch tray unit 160, dropping the first predetermined number of sheets into a sheet receiving device 14, in one embodiment. The sheet receiving device 14 may, in one embodiment, be a secondary sheet-feeding device located below the retractable landing platform 253.

After the first predetermined number of sheets is dropped from the retractable landing platform 253, the CPU 18 may, in one embodiment, send a signal to the horizontal actuator unit 250 to return the retractable landing platform 253 to an extended position, in block 410. The CPU 18 may also in block 410, send a signal to the vertical actuator unit 240 to return the horizontal actuator unit 250 to an upper position. The CPU 18 may then, in one embodiment, send a signal to the sheet-delivery mechanism 12, in block 414, to begin delivery of a second predetermined number of sheets to the dual stage dropper 10.

The retractable landing platform 253, in one embodiment, after receiving the signal for the second delivery, may be gradually lowered by the vertical actuator unit 240 so that the top of the growing stack of sheets stays at a distance of at most 1.5 inches or at most 2 inches below the discharge level of the sheet-delivery mechanism 12. In one embodiment, a first-stage-stack sensor 20 is mounted on the horizontal actuator unit 250 and directed toward a gap between the first sliding catch tray unit 150 and the second sliding catch tray unit 160 of the first-stage module 100. In one embodiment, the first-stage-stack sensor 20 is lowered along with the horizontal actuator unit 250 as sheets are fed onto the retractable landing platform 253. When the first-stage-stack sensor 20 is lowered to a point where it senses a presence of sheets cradled in the gap between the first sliding catch tray unit 150 and the second sliding catch tray unit 160, in one embodiment, the first-stage-stack sensor 20 automatically sends a signal to the CPU 18, which directs the sheet-delivery mechanism 12 to interrupt the flow of sheets being delivered to the dual stage dropper 10 until the sheets are dropped from the from the first-stage module 100. In one embodiment, the sensing of existing sheets and signaling a stop of the dual stage dropper 10 lowers the risk of jam.

In one embodiment, after the sheets are cleared from the first-stage module 100, the CPU 18 directs the sheet-delivery mechanism 12 to resume delivery of the second predetermined number of sheets to the dual stage dropper 10. Delivery of additional pre-set numbers of sheets can be cycled through the dual-stage dropper 10 as described above.

The addition of a second-stage module 200 allows for an increased stack height that can be accommodated by the dual stage dropper 10. For example, the dropper 10 may be able to accommodate stacks in excess of 2 inches, or even in excess of 3 inches, or even in excess of 4 inches, or even in excess of 5 inches, or even in excess of 6 inches.

Although the present invention has been described with reference to preferred embodiments, workers skilled in the art will recognize that changes may be made in form and detail without departing from the spirit and scope of the invention.

What is claimed is:

1. A method for rapidly stacking and dropping sheets, using a stacking and dropping apparatus, the method comprising;

receiving a plurality of sheets, discharged by a sheet delivery device, onto a landing platform of the stacking and dropping apparatus;

lowering the landing platform, using a vertical actuator unit with a vertical piston, from an original upper position, wherein lowering comprises maintaining a drop height between the sheet delivery device and a stack of delivered sheets, and wherein the vertical actuator is configured to lower the landing platform based on a received command from a controller of the stacking and dropping apparatus;

sending a delay signal, generated by the controller, wherein the delay signal comprises a command to delay the receiving of the plurality of sheets from the sheet delivery device and wherein the delay signal is sent in response to a detection of a predetermined stack height, detected by a stack sensor, of the stack of delivered sheets;

sending a movement signal, generated by the controller, wherein the movement signal follows the delay signal, wherein the movement signal comprises a command to move the landing platform, using a horizontal actuator unit with a horizontal piston, such that the plurality of sheets are received by a catch tray unit;

dropping, utilizing the catch tray unit, the plurality of sheets onto a sheet receiving device;

returning, automatically, using the vertical piston, the landing platform to the original upper position;

sending a resume signal, generated by the controller, that includes a command to the sheet delivery device to resume sheet delivery; and wherein the controller comprises a central processor component configured to generate the delay, movement and resume signals based on received sensor signals.

2. The method of claim 1, wherein the movement signal is indicative of a horizontal movement.

3. The method of claim 1, and further comprising monitoring the sheets on the catch tray.

4. The method of claim 3, and further comprising sending a second delay signal, generated by the controller, upon detection of a sheet on the catch tray unit, wherein the second delay signal comprises a command to delay the receiving of the plurality of sheets from the sheet delivery device.

5. The method of claim 4, wherein the controller repeatedly generates and sends the second delay signal until no sheet is detected on the catch tray unit.

6. The method of claim 1, wherein the landing platform is attached to a second stage module and the catch tray unit is attached to a first stage module.

7. The method claim of 6, and further comprising separating the first stage module from the second stage module.

8. A dual-stage sheet stacking and dropping apparatus for placement adjacent to a sheet-delivery mechanism comprising:

a first stage module comprising:

a catch tray unit; and a first actuator, configured to control a horizontal position of a sliding catch tray unit;

a second stage module comprising:

landing platform;

a second actuator, configured to control vertical position of the landing platform; and a third actuator, configured to control a horizontal position of the landing platform;

an attachment unit configured to facilitate connection and separation of the first stage module from the second stage module, wherein the attachment unit is configured to connect the first stage module to the second stage module; and wherein the attachment unit is configured to allow separation of the first stage module from the second stage module upon a detection of a jam.

9. The system of claim 8, wherein the attachment unit further comprises a plurality of rails and a plurality of sliding components, each configured to attach to the first stage module and to the second stage module, such that the first stage module and second stage module are configured to slide on the plurality of rails.

10. The system of claim 9, wherein each of the sliding components are configured to fit together through a hinged lock mechanism.

11. The system of claim 9, wherein each of the sliding components are configured to fit together by a threaded fastener mechanism.

12. The system of claim 8, wherein the jam comprises a sheet that has failed to drop from the sliding catch tray unit of the first stage module.

* * * * *